US005971361A

United States Patent [19]

Heimbach et al.

[11] Patent Number: 5,971,361

[45] Date of Patent: Oct. 26, 1999

[54] CLAMPLESS LAMINATE FLOORING TOOL

[76] Inventors: Jacob C. Heimbach, 4441 Atkins Rd.; Keith A. MacNeil, 2735 - 17th Ave., both of Port Huron, Mich. 48060

[21] Appl. No.: 08/842,883

[22] Filed: Apr. 17, 1997

[51] Int. Cl.[6] ..... A47G 27/04

[52] U.S. Cl. ..... 254/16; 254/104

[58] Field of Search ..... 254/11, 15–17, 254/104; 269/234

[56] References Cited

U.S. PATENT DOCUMENTS

| | | | |
|---|---|---|---|
| 822,126 | 5/1906 | Hopkins | 254/11 |
| 1,568,885 | 1/1926 | Derby . | |
| 2,377,962 | 6/1945 | Preston | 269/234 |
| 2,424,090 | 7/1947 | Gordinier | 269/234 |
| 2,588,401 | 3/1952 | Miller . | |
| 2,743,902 | 5/1956 | Porter . | |
| 2,864,581 | 12/1958 | Harrison . | |
| 3,170,322 | 2/1965 | Cavanaugh | 269/234 |
| 3,524,623 | 8/1970 | Campbell . | |
| 3,734,481 | 5/1973 | Surwill et al. | 269/234 |
| 4,027,867 | 6/1977 | Pollington | 269/234 |
| 4,620,691 | 11/1986 | Waters, Jr. . | |
| 5,139,231 | 8/1992 | Temple . | |
| 5,788,221 | 8/1998 | Muhlebach | 254/16 |

FOREIGN PATENT DOCUMENTS

| | | |
|---|---|---|
| 2785 | of 1876 | United Kingdom . |
| 377468 | 8/1932 | United Kingdom . |

*Primary Examiner*—Robert C. Watson
*Attorney, Agent, or Firm*—Christopher John Rudy

[57] ABSTRACT

Clampless flooring tool includes a base, a wedge sidewardly guidable by and in slidable contact with the base, and a force applying device secured to the base and in contact with the wedge, which drives the wedge sidewardly. The wedge provides a force oblique to the force applied from the force applying device such that a flooring piece can be acted upon by the oblique force in a direction oblique to the direction of the force applied by the force applying device. An obliquely movable member, which, in addition, may be sidewardly immovable, may be provided between and in contact with the wedge for contact with the flooring. The tool is especially useful in installation of laminate flooring.

4 Claims, 3 Drawing Sheets

CLAMPLESS LAMINATE FLOORING TOOL

FIELD

The present invention concerns a flooring installation tool.

BACKGROUND

In the installation or laying of flooring materials such as tongue in groove style flooring, it is important for the flooring pieces to be in tight contact while the same are being secured in place. Various flooring installation tools for such purposes are known. See, e.g., U.S. Pat. Nos. 1,568,885 to Derby; 2,588,401 to Miller; 2,743,902 to Porter; 2,864,581 to Harrison; 3,524,623 to Campbell; 4,620,691 to Waters, Jr., and 5,139,231 to Temple. See also, U.K. Patent Specification Nos. 2,785 (A.D. 1876 Jul. 8) and 377,468 (Aug. 18, 1932). One feature of most of the devices disclosed by the foregoing documents is that the direction of the force which is applied to the flooring is parallel with the force applied to the device lever by the device operator. The Harrison device, however, employs a jaw member pivotally mounted on a stud and transverse force thereon to press or crowd floorboard tightly against the last board nailed in place such as with bent boards.

As useful as they may be, such devices are generally unsuitable for the laying of modern laminate flooring materials, including those of the tongue and groove type. Modern laminate flooring can become damaged more easily in installation than solid board flooring but has the same requirement that the pieces should fit in tight contact while they are secured in place.

SUMMARY

The present invention provides a clampless flooring tool, which comprises a base, a wedge sidewardly guidable by and in slidable contact with the base, and a force-applying device secured to the base and in contact with the wedge, which drives the wedge laterally, the wedge correspondingly providing a force oblique to the force applied from the force-applying device such that a flooring piece can be acted upon by the oblique force in a direction oblique to the direction of the force applied by the force-applying device. An obliquely movable member, optionally laterally immovable also, can optionally be provided between and in contact with the wedge for contact with the flooring.

The invention is useful in the installation of flooring.

Significantly, by the invention, modern laminate flooring such as parquet flooring pieces and so forth can be installed efficiently upon a subfloor without damage to the laminate flooring. The device is simple in manufacture and in use.

Numerous further advantages attend the invention.

DRAWINGS

The drawings form part of the specification hereof. In the drawings, not necessarily drawn to scale, the following is noted:

ILLUSTRATIVE DETAIL

The invention can be more fully understood by consideration of the present detail, which may be taken with reference to the appended drawings. The same is to be taken in an illustrative and not necessarily limiting sense.

Figure 1:
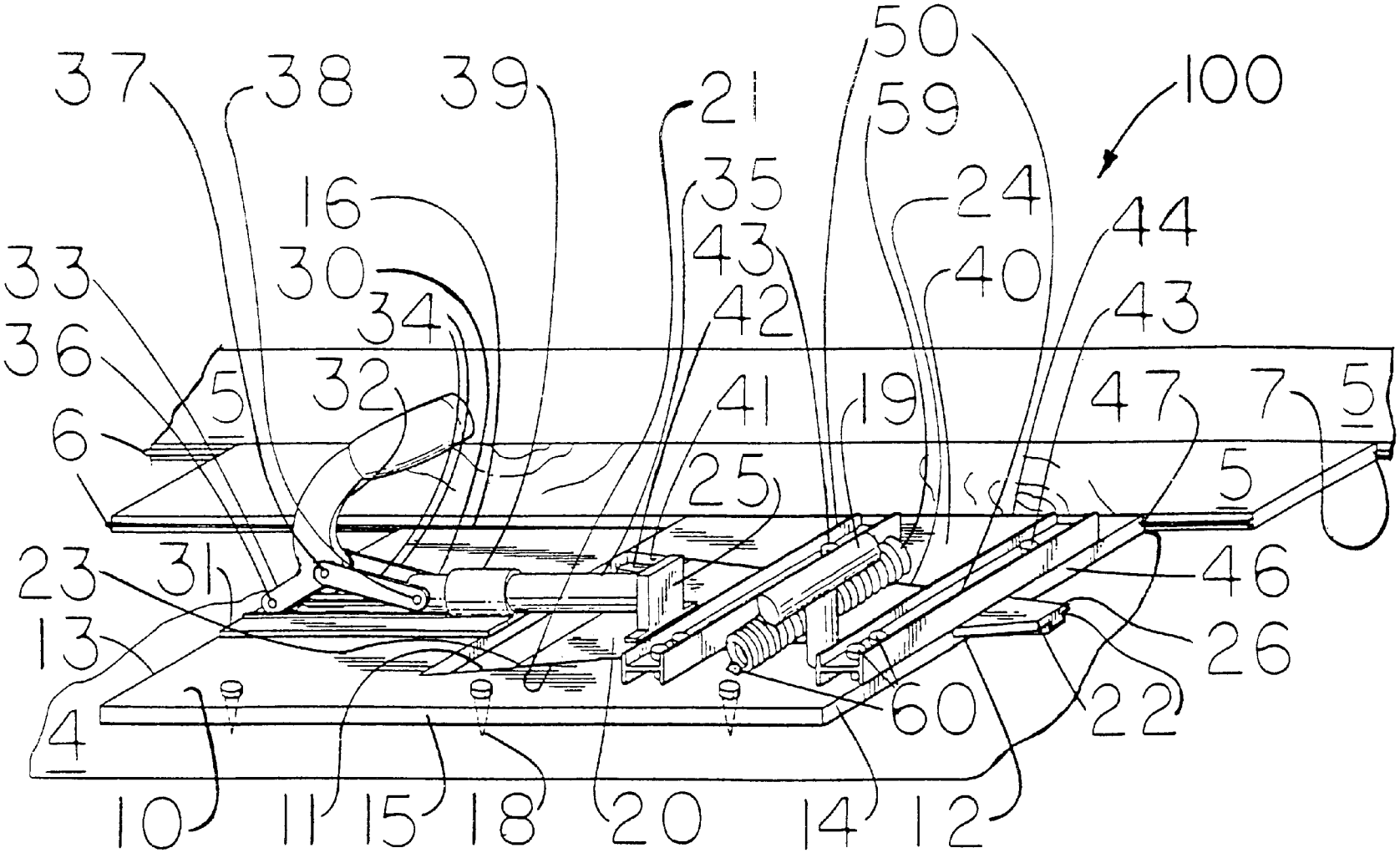
FIG. 1 is top right front perspective view of an embodiment of a clampless laminate flooring tool of the present invention.

With reference to FIG. 1, clampless laminate flooring tool 100 is positioned on subfloor 4 and operates on flooring 5. The flooring 5 may be of the tongue 6 and groove 7 laminate variety.

Figure 2:
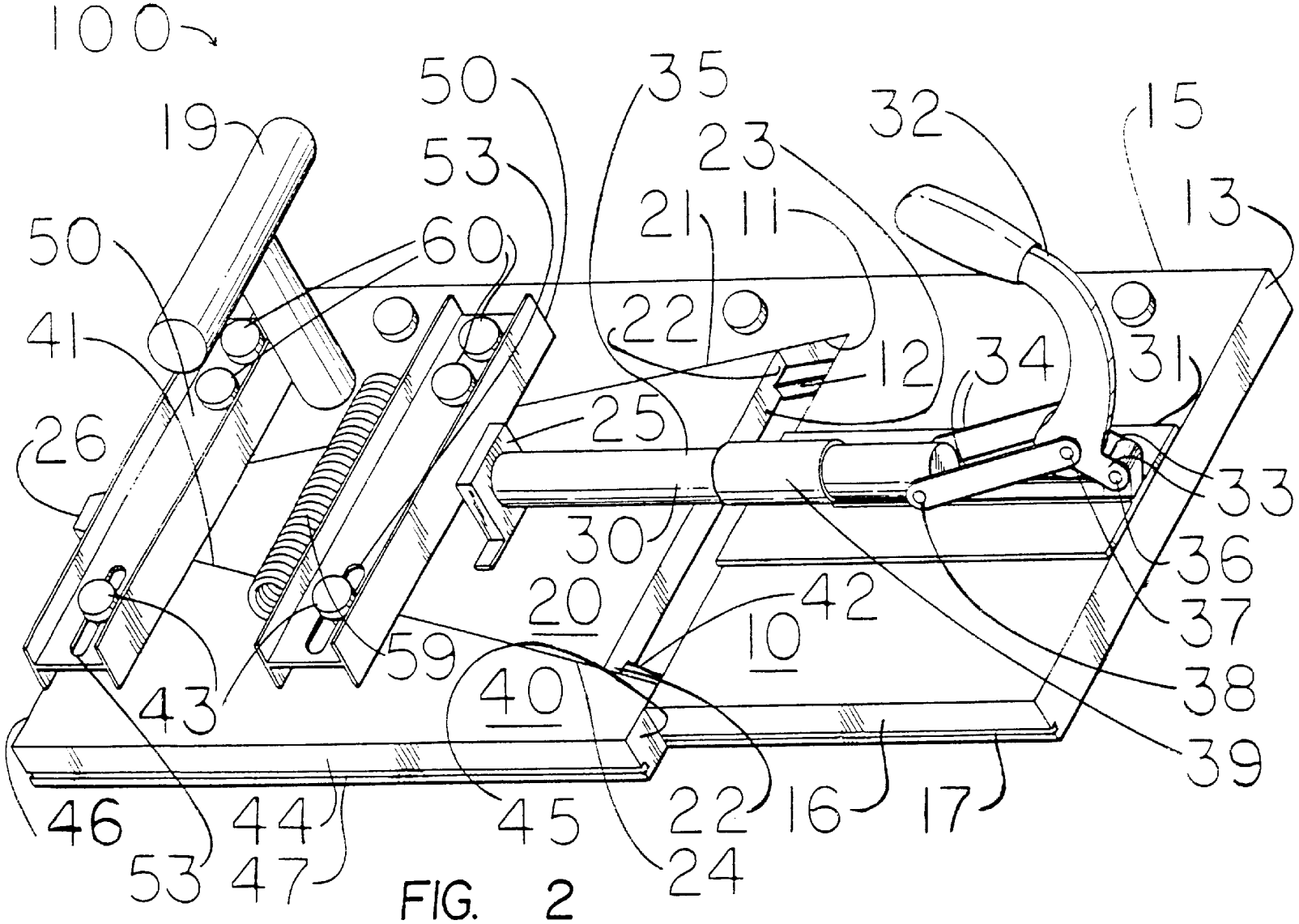
FIG. 2 is a top left rear perspective view of the same tool.
Figure 3:
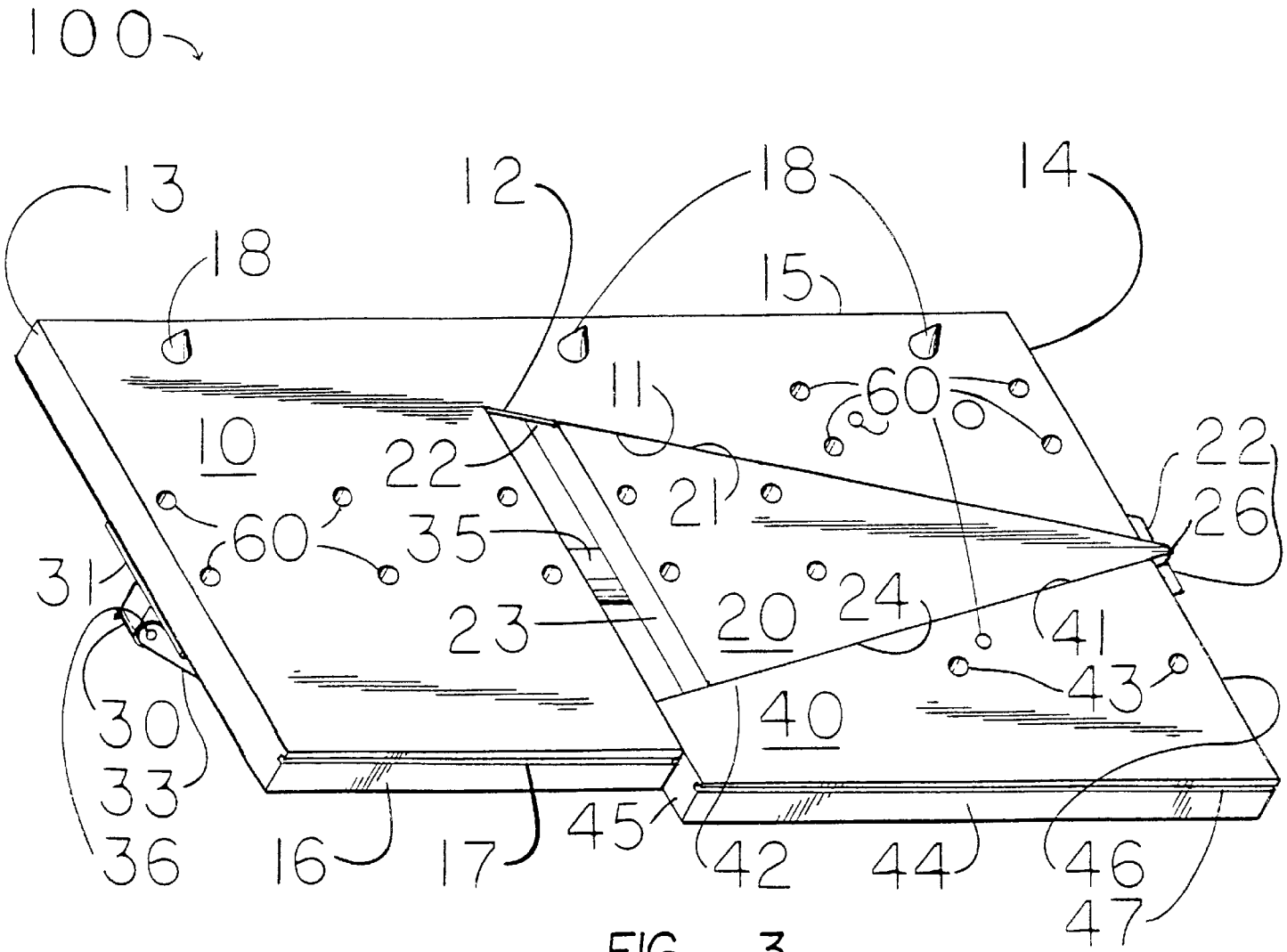
FIG. 3 is a bottom left rear perspective view of the same.

With reference to FIGS. 1, 2 & 3, in general, the clampless laminate flooring tool 100 includes base 10, wedge 20, and force-applying device 30. The wedge 20 is sidewardly guidable by and in slidable contact with the base 10. The force applying device 30 is secured to the base 10 and is in contact with the wedge 20. Force from the force-applying device 30 can drive the wedge 20 laterally. Correspondingly, the wedge 20 can provide a force oblique to the direction of force applied from the force-applying device 30. Accordingly, as seen in FIG. 1, the flooring 5 can be acted upon by the oblique force in a direction oblique to the direction of the force applied by the force-applying device 30, and further, obliquely movable member 40, between and in contact with the wedge 20 for contact with the flooring 5 and preferably laterally immovable, can be interposed to transmit the force.

The base 10 includes obliquely-angled, wedge-guiding surface 11, and wedge-supporting ledge 12; restive lateral end 13, and, opposite the end 13, active lateral end 14; restive, back end 15, and, opposite the end 15, active, front end 16. Also provided can be groove 17, for initial registry with the tongue 6 of the flooring 5; spurs 18 on the bottom, for penetrating into the subfloor 4 and setting the base 10 in an immovable posture, which may be assisted by the operator kneeling on the top of the base 10; and handle 19, for ease of movement to a new location and operation of the tool 100.

The wedge 20 includes obliquely-angled guidable surface 21, for registry and contact with the base wedge-guiding surface 11; shoulders 22, under which a wedge-supporting ledge can reside in registry and because of which the wedge-supporting ledge can be made more thick and substantial; internal end 23; front surface 24; lateral force-accepting member 25, for accepting force from the force-applying device 30; and lateral end 26. A wedge front surface can directly contact the flooring if no further obliquely movable member such as the member 40 is present. Desirably, however, the front surface 24 comes in direct contact with an obliquely movable member 40, and the obliquely movable member directly contacts the flooring 5.

The force-applying device 30 can be of a generally standard, manually operated lever type, and includes frame 31; pivotally movable arm 32; first pivoting lower section 33 immovably attached to or integral with the arm 32, which extends upwardly from the frame 31 into the arm 32; second pivoting lower section 34, which extends from the junction of the arm 32 with the first pivoting lower section 33 and downwardly to connect with piston 35, which can come into contact with the lateral force-accepting member 25 of the wedge 20, and force the same laterally toward the active lateral end 14 of the base 10; pivots 36, 37 & 38; and piston collar 39, through which the piston 35 can slide back and forth. By applying force to the arm 32, the sections 33 & 34 and piston 35 are movable toward the active lateral end 14 of the base 10. When the piston 35 contacts the lateral force-accepting member 25 and the lateral force remains applied, the wedge 20 can be moved laterally toward the active lateral end 14 of the base 10. Note, Campbell, U.S. Pat. No. 3524623. In turn, the wedge 20 can direct force in a direction toward the active, front end 16 of the base 10.

Some alternative embodiments for the force-applying device may include ratchet, gear-driven and screw-type devices, whether manually or otherwise powered; spring devices; expansible devices such as those thermally or electrically actuated; electromagnetically actuated devices; pneumatically actuated devices, including those driven by vacuum, or compressed air, steam, internal combustion, gunpowder, and so forth; and hydraulically actuated devices. See, FIG. 4.

The obliquely movable member 40 includes obliquely-angled guidable surface 41, for registry and contact with the guiding surface 24 of the wedge 20; wedge-supporting ledge 42, which can reside under and be in registry with the forward one of the wedge shoulders 22; one or more lateral movement restraining stops 43, which can be in the form of studs, screws and the like, and which can cooperate in restraining the obliquely movable member 40 from lateral movement, which is desirable; front surface 44, which comes into contact with the piece of flooring 5 being positioned for securement; internal end 45; and lateral end 46. Groove 47 can register with the tongue 6 of the flooring 5.

Preferably, the direction of the oblique force which can be applied from the tool 100 is substantially perpendicular to the direction of the force applied by the force applying device 30. Such can be accomplished, for example, in a generally rectangular tool such as is the tool 100 of FIGS. 1–3, by providing the wedge 20 in the basic form of an isosceles triangle with the direction of the force provided through the force-applying device 30 running along an axis medial the two equal sides of the wedge 20, or parallel thereto. In turn, the obliquely movable member 40, and its flooring-contacting end 44, can apply force to flooring 5 in a direction perpendicular to the direction of the force from the force-applying device 30.

One or more top restraints 50, among other things, when secured to the base 10, can keep the wedge 20 and obliquely movable member 40 from becoming dislodged from the base 10 and tool 100. The top restraint 50 has obliquely directed slot 53, which can cooperate with a lateral movement restraining stop 43 in restraining the obliquely movable member 40 from lateral movement. It is along the axes of such a slot 53, which, when two or more obliquely directed slots 53 are employed, generally run in parallel, that the obliquely movable member 40 is forced. Tension device 59 such as a spring can act to keep the obliquely movable member 40 under tension so that it returns in a direction toward the restive, back end 15 of the base when force is no longer applied through the force-applying device 30 and wedge 40.

Fasteners 60 can be employed to hold parts together.

The clampless laminate flooring tool of the invention can be made of any suitable materials such as, in general, metal, wood, cellulosic composite, thermoset resin, thermoplastic resin, stone and/or ceramic, and so forth; be welded, glued, screwed, riveted, nailed and/or stapled together where appropriate; and be of any suitable size or dimension. For example, the clampless laminate flooring tool 100 as of FIGS. 1–3 can have its base 10, wedge 30 and obliquely movable member 40 made from ¾-inch aluminum, and its other components, including force-applying device 30, made from steel; employ suitable screws or studs as the fasteners 60; and have features with the following dimensions:

| Feature | Dimension |
|---|---|
| 13 | 9¾ inches. |
| 14, 46 | 4½ inches. |
| 15 | 24½ inches. |
| 16 | 8 inches. |
| 17, 47 | 3/32 × 3/32 inches, 9/16 of an inch from the top surface and 3/32 of an inch from the bottom surface. |
| 22 | ⅜ × ⅜ inches. |
| 23 | 6½ inches. |
| 26 | 1¼ inches. |
| 44 | 16½ inches. |
| 45 | 1¾ inches. |

Such dimensions may be considered to be approximate.

To recapitulate, the flooring tool of the invention includes abase a wedge sidewardly guidable by and in slidable contact with the base, and a force applying-device secured to the base and in contact with the wedge, which drives the wedge sidewardly. The wedge provides a force oblique to the force applied from the force-applying plying device such that a flooring piece can be acted upon by the oblique force in a direction oblique to the direction of the force applied by the force-applying device. An obliquely movable member, which, in addition, may be sidewardly immovable, may be provided between and in contact with the wedge for contact with the flooring.

The tool has proven highly effective with laminate flooring.

CONCLUSION

The present invention is thus provided. Numerous modifications can be effected within its spirit, the literal claim scope of which is particularly pointed out as follows:

We claim:

1. A clampless tool useful for installing laminate flooring, which comprises the following parts:

a base, which includes obliquely-angled, wedge-guiding surface; a wedge-supporting ledge; a restive lateral end, and, opposite the restive lateral end an active lateral end; a restive, back end, and, opposite the restive, back end, an active, front end; and spurs on the bottom, for penetrating into a subfloor and setting the base in an immovable posture;

a wedge, which includes an obliquely-angled guidable surface for registry and contact with the base wedge-guiding surface; shoulders, under which a wedge-supporting ledge can reside in registry; a lateral force-accepting member for accepting force from a force-applying device; and a front surface, which can come in contact with an obliquely movable member;

the force-applying device, which includes a frame; a pivotally movable arm; a first pivoting lower section immovably attached to or integral with the arm, which extends upwardly from the frame into the arm; a second pivoting lower section, which extends from the junction of the arm with the first pivoting lower section and downwardly to connect with a piston, which piston can come into contact with the lateral force-accepting member of the wedge, and force the same laterally toward the active lateral end of the base; pivots at each end of the first and second sections and about a terminal end of the arm; and piston collar, through which the piston can slide back and forth—such that by applying force to the arm, the first and second sections and the piston are movable toward the active lateral end of the base, and when the piston contacts the lateral force-accepting member and the lateral force remains applied, the wedge can be moved laterally toward the active lateral end of the base, and, in turn, the wedge can direct force in a direction toward the active, front end of the base;

the obliquely movable member, which includes an obliquely-angled guidable surface, for registry and contact with the guiding surface of the wedge; a wedge-supporting ledge, which can reside under and be in registry with a forward one of the wedge shoulders; a lateral movement restraining stop, which can cooperate in restraining the obliquely movable member from lateral movement; and front surface, which can come into contact with the piece of flooring being positioned for securement; and a top restraint, which, when secured to the base, clan keep the wedge and obliquely movable member from becoming dislodged from the base and tool, having an obliquely directed slot, which can cooperate with the lateral movement restraining stop in restraining the obliquely movable member from lateral movement wherein the direction of the oblique force which can be applied from the tool is substantially perpendicular to the direction of the force applied by the force applying device.

2. The tool of claim 1, wherein the wedge basically takes the form of an isosceles triangle with the direction of the force of the force-applying device running along an axis medial the two equal sides of the wedge, or parallel thereto.

3. The tool of claim 2, wherein there are present a plurality of restraining stops in the obliquely movable member, a plurality of top restraints and a plurality of obliquely directed slots in the top restraints, running in parallel, which can cooperate with the lateral movement restraining stops in restraining the obliquely movable member from lateral movement, and along the axes of these slots that the obliquely movable member is forced; a groove is present in the obliquely movable member, which can register with the tongue of tongue and groove laminate flooring; a tension device is present to act to keep the obliquely movable member under tension so that it returns in a direction toward the restive, back end of the base when force is no longer applied through the force-applying device and wedge; and a handle is present with the tool.

4. The tool of claim 3, which is in a generally rectangular form.

* * * * *